United States Patent [19]

Vines

[11] 4,106,434

[45] Aug. 15, 1978

[54] PAINTER PAD APPLICATOR

[75] Inventor: Ellsworth Vines, Wellesley, Mass.

[73] Assignee: Baltimore Brushes, Inc., Brockton, Mass.

[21] Appl. No.: 820,578

[22] Filed: Aug. 1, 1977

[51] Int. Cl.[2] ..... B05C 1/02

[52] U.S. Cl. ..... 118/258; 15/257.05; 29/121.5; 118/DIG. 15

[58] Field of Search ..... 118/DIG. 15, DIG. 17, 118/258; 15/230.1 L, 257.05; 29/110.5, 121.5, 115; D64/18

[56] References Cited

U.S. PATENT DOCUMENTS

| | | | |
|---|---|---|---|
| 840,822 | 1/1907 | Calkins | 118/423 X |
| 1,213,728 | 1/1917 | Beach | 118/249 X |
| 2,813,292 | 11/1957 | McLendon | 118/258 X |
| 3,425,086 | 2/1969 | Ball | 29/110.5 X |
| 3,711,887 | 1/1973 | Chapman | 15/230.11 |
| 4,025,205 | 5/1977 | Hawk | 15/230.11 X |

FOREIGN PATENT DOCUMENTS

| | | | |
|---|---|---|---|
| 960,188 | 12/1974 | Canada | 118/258 |

*Primary Examiner*—John P. McIntosh
*Attorney, Agent, or Firm*—Cesari and McKenna

[57] ABSTRACT

A painter pad applicator comprises a faceted roller rotatively mounted in brackets that can be removably secured to the side walls of a conventional paint tray so that the roller is positioned transversely in the paint tray well. The roller is buoyant in the paint contained in the paint tray and the brackets are arranged to permit vertical movement of the roller in the tray so that as the paint level changes the roller follows with a selected amount of roller surface area always projecting above the surface of the paint.

5 Claims, 3 Drawing Figures

PAINTER PAD APPLICATOR

BACKGROUND OF THE INVENTION

This invention relates to an applicator for applying paint to the surface of a painter pad.

A painter pad is a sponge like pad having a nap surface which is attached to a handle and used in lieu of a brush or paint roller to apply paint or other liquid to a wall or other surface. Paint can be applied to the pad by carefully dipping the pad slightly into a body of paint contained in the well of a conventional paint tray or other container. However this is not a particularly desirable way to apply paint to the pad because in many cases the pad takes on too much paint so that when the pad is stroked across the wall to be painted an excessive thickness of paint is applied to the wall. Consequently the wall area covered by a given volume of paint is relatively small.

There are prior applicators which attempt to avoid this problem. Invariably they comprise a paint container having a cylindrical applicator rotatively mounted transversely in the container. With the container filled with paint, the painter pad is drawn across the roller. This tends to rotate the roller so that paint is applied to successive circumaxial areas of the roller surface, which paint is then transferred to the painter pad.

While these prior applicators work reasonably well they still have drawbacks which render them, at best, inconvenient to use. More particularly, the rollers used in these prior applicators are invariably cylinders of large diameter so that diametrically opposite portions of the roller surface will be immersed in and project above the liquid in the container both when the container is full and when it is nearly empty. Therefore in order to keep the overall size and weight of the applicator within reasonable bounds, the cylinder is made only slightly longer than the smaller dimension of the rectangular painter pad so that the pad has to be drawn across the roller sideways. Consequently in order to load the pad with paint uniformly over its entire area, the user has to stroke the pad back and forth several times on the roller with the roller making several complete turns. Needless to say, this is tedious and time consuming.

Furthermore, when the prior applicators are used to apply thixotropic paint to the painter pad, the paint, being pudding-like, inhibits rotation of the roller and the pad itself tends to skid or slide over the surface of the roller rather than to turn the roller. Resultantly, the roller does not always present a freshly coated surface to the pad as the pad is stroked over the roller. This sometimes results in inadequate loading of the roller. Attempts to alleviate this problem by forming lengthwise ribs on the roller that "bits" into the pad surface to provide sufficient traction to turn the roller have not proven to be a satisfactory solution. This is because the ribs themselves interfere with the uniform application of paint to the entire surface of the pad so that the pad, in turn, does not apply the paint uniformly to the wall or other surface being painted.

Finally these prior paint applicators tend to be relatively expensive and they are dedicated exclusively to applying paint to pads so that their paint containers cannot be used with paint rollers.

SUMMARY OF THE INVENTION

Accordingly, the present invention aims to provide an improved applicator for applying paint to painter pads.

Another object of the invention is to provide an applicator of this type which applies the proper amount of paint to a painter pad over the entire area of the pad.

Still another object of the invention is to provide an applicator for painter pads which is relatively inexpensive to make.

Yet another object is to provide an applicator of this type which can be installed on a conventional paint tray used for paint rollers.

Yet another object is to provide an applicator such as this which is relatively compact.

A further object is to provide such an applicator for a painter pad that applies the paint uniformly as the paint level in the applicator container changes.

Other objects will, in part, be obvious and will, in part, appear hereinafter.

The invention accordingly comprises the features of construction, combination of elements and arrangement of parts which will be exemplified in the following detailed description and the scope of the invention will be indicated in the claims.

Briefly, the subject applicator for painter pads can be removably installed in any conventional metal or plastic paint tray otherwise used with a standard paint roller. The applicator includes a relatively small diameter elongated roller rotatively mounted between a pair of brackets which can be clipped to the side walls of the paint tray with the roller extending transversely across the tray well adjacent the bottom of the well.

The roller is hollow and made of a light-weight plastic material so that it is buoyant and floats in the paint contained in the tray well. Also, the brackets are designed so that the ends of the roller are free to slide so that the roller as a whole moves vertically in the well as the level of the paint in the well varies.

Furthermore, the buoyancy of the roller is such that a roller surface area of a selected size always projects above the surface of the paint, while a lower portion of the roller is always immersed in the paint as the level of the paint in the tray well drops.

Preferably also the roller is formed with flat faces or facets with rounded corners between the facets which are engaged by the painter pad as the pad is drawn over the roller. The roller shape coupled with the fact that only a relatively small portion of the roller is immersed in the paint assures that when the pad is stroked across the roller, the roller will turn even when immersed in thixotropic paint and thus present a freshly coated surface to the pad over the entire area of the pad. Still, the roller facets, being flat, apply a uniform coating to the pad in contrast to prior ribbed roller designs.

Since the present applicator roller floats in the paint and moves up and down with the paint level, its diameter can be relatively small. Therefore the roller can be made longer than the length of the conventional painter pad so that the entire length of the painter pad can be drawn across the roller. Resultantly only a few back and forth strokes of the pad on the roller are required to load the pad uniformly with the desired amount of the paint. Any excess paint can be scraped from the pad by drawing it across the edge of the end wall of the paint tray.

The components of the present applicator are simple molded plastic or stamped metal parts. Consequently they can be fabricated relatively inexpensively. Furthermore, since present applicator can be used with any standard paint, tray additional cost savings result.

BRIEF DESCRIPTION OF THE DRAWING

For a fuller understanding of the nature and objects of the invention, reference should be had to the following detailed description, taken in connection with the accompanying drawing, in which.

DESCRIPTION OF THE PREFERRED EMBODIMENT

Figure 1:
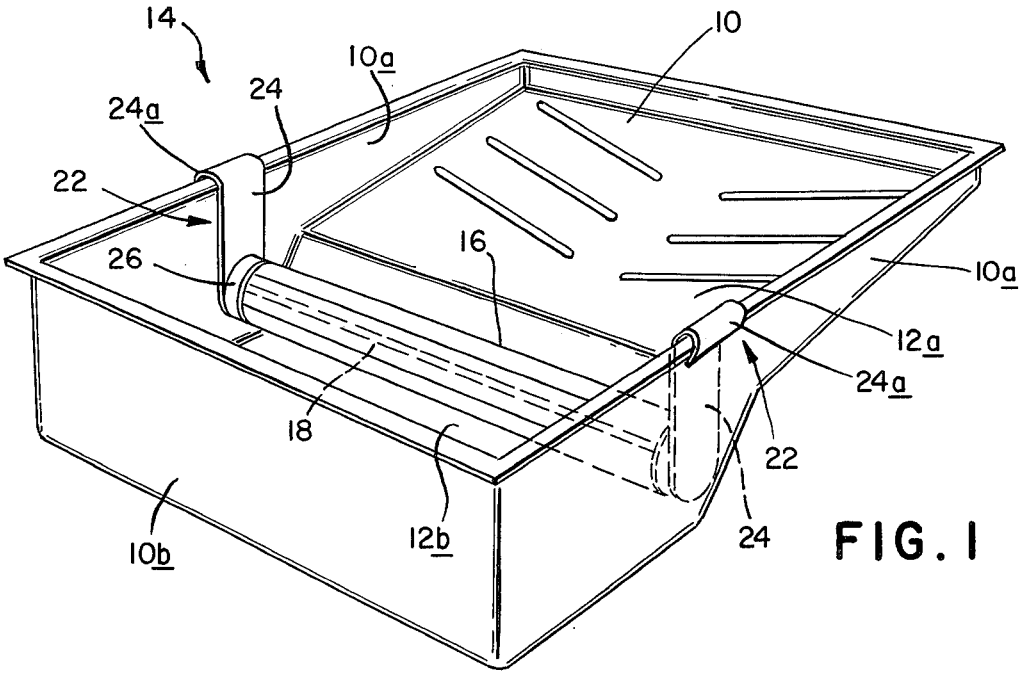
FIG. 1 is a perspective view of an applicator for painter pads installed in a conventional paint tray.

Referring first to FIG. 1 of the drawing, the present applicator is used with a container which in the illustrated embodiment is a tray 10 that is customarily used to apply paint to a paint roller. Tray 10 has a pair of side walls 10*a* and a relatively high end wall 10*b*. Tray 10 also has an inclined bottom wall 12*a* that ramps down into a well 12*b*. The applicator shown generally at 14 is movably positioned in the tray well 12*b* adjacent the bottom of ramp 12*a* and extends across the entire width of the tray.

Figure 2:
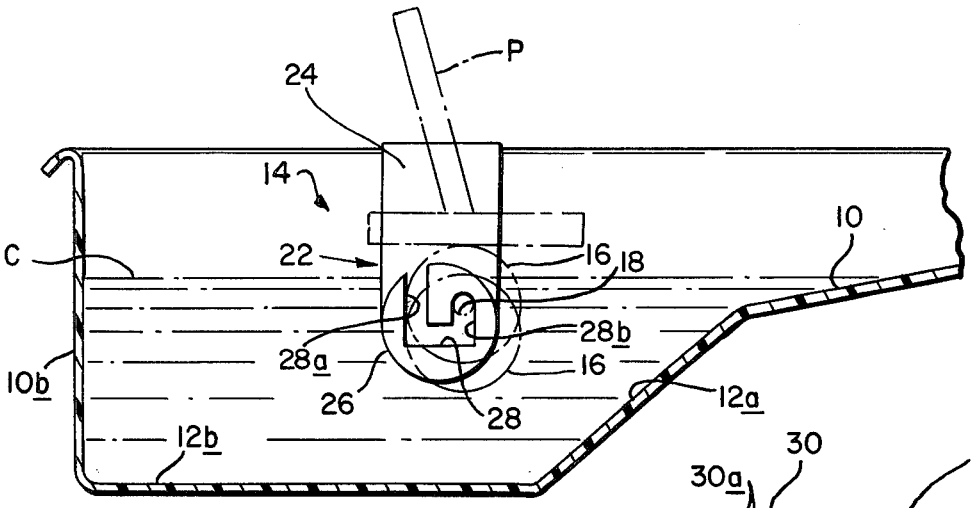
FIG. 2 is a fragmentary sectional view of the FIG. 1 tray, with parts shown in phantom.

Referring now to FIGS. 1 and 2, applicator 14 comprises an elongated roller 16 rotatively mounted on an axle 18 extending through the roller and whose ends are supported by a pair of identical brackets shown generally at 22. Each bracket includes a strap 24 whose upper end is bent back on itself at 24*a* and is somewhat resilient so that it can be snapped over the flanged edge of a paint tray wall 10*a*. The lower end of strap 24 terminates in an inwardly projecting boss 26 in which is formed a U-shaped slot 28. The long vertical leg 28*a* of the slot extends all the way to the top of the boss while a shorter vertical leg 28*b* extends only partway to the top of the boss. Resultantly, the ends of the axles can be dropped into the slots to reside in the legs 28*b* where the axle is captured, but free to move vertically permitting roller 16 to move between upper and lower positions shown in dotted lines in FIG. 2.

Figure 3:
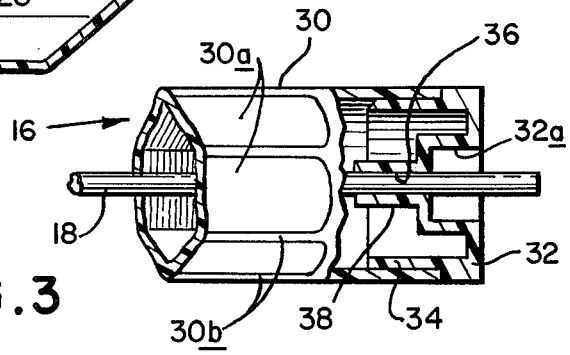
FIG. 3 is a fragmentary elevational view with parts cut away showing the applicator roller in greater detail.

Turning now to FIG. 3, roller 16 comprises an elongated thin-walled tube 30 made of plastic or other light-weight material. The tube is not cylindrical; rather it is formed with a plurality of lengthwise facets or faces 30*a* separated by rounded corners 30*b*. In the illustrated roller embodiment, there are five such facets 30*a*.

Plugged into the opposite ends of tube 30 are a pair of identical bushings 32. Each bushing is counterbored at 32*a* and provided with a reduced diameter neck 34 over which the end of the tube 30 is engaged and anchored by a suitable cement. An axial passage 36 is formed through each bushing, extending from the counterbore 32*a* through a small diameter neck 38 formed at the inner side of each bushing. Each passage 36 is sized to loosely receive the axle 18 so that the bushings and therefore the roller as a whole are free to revolve on the axle.

The roller 16 being hollow and constructed for the most part of light-weight plastic material is buoyant so that it tends to float in the paint or other coating C, with the upper portion of the roller projecting above the surface of the liquid and the lower portion of the roller remaining immersed in the liquid as shown in FIG. 2. Resultantly, an adaquate surface area of the roller is always exposed to the surface of a painter pad P drawn across the roller as shown in dotted lines in FIG. 2.

As the pad is stroked over the roller, the tube corners 30*b* grab the surface of the pad to some extent which helps the roller to be turned. This fact, coupled with the fact that only a relatively small portion of the roller is immersed in the paint means that the roller can be turned relatively readily even when highly viscous paint is being applied to the pad.

Also since the roller 16 is relatively long, it can accommodate the entire length of the painter pad P so that only a few strokes of the pad over the roller are required in order to apply paint uniformly to the pad.

The positional relationship of the roller to the paint remains the same whether the tray 10 is filled with paint or is nearly empty because the roller rises and falls with the paint level with the roller axles 18 sliding up and down in slots 28. Thus whether the tray 10 is full or nearly empty, the same amount of roller surface area will project above the surface of the paint and the same amount of surface area will remain immersed in the paint. Consequently one is assured that an adequate amount of paint will be loaded into the pad as it is stroked across the roller. Excessive paint is removed from the pad simply by wiping the underside of the pad on the flanged upper edge of the tray end wall 10*b*.

It will thus be seen that the objects set forth above, among those made apparent from the preceding description, are attained efficiently and since certain changes may be made in the above construction without departing from the scope of the invention, it is intended that all matter contained in the above description or shown in the accompanying drawing be interpreted as illustrative and not in a limiting sense.

It is also to be understood that the following claims are intended to cover all the generic and specific features of the invention herein described.

I claim:

1. An applicator for applying coating liquid from a container to a painter pad, said applicator comprising A. an elongated roller, said roller being formed with a circumferential array of lengthwise planar facets or faces adapted for continuous wiping engagement with the pad, the ostensible outer diameter of said roller being appreciably less than the height of the container, B. a pair of brackets removably secured to the walls of the container, C. axle means supported by the brackets for rotatively mounting the roller, D. means on the brackets for permitting the roller to slide relative to the brackets, and E. said roller being buoyant in the liquid being applied to the pad so that when the brackets are secured to the container filled with the liquid, the roller floats in the liquid with an upper portion of the roller projecting out of the liquid and a lower portion of the roller being immersed in the liquid as the liquid level in the container varies.

2. The applicator defined in claim 1 wherein the roller has a polygonal cross-section.

3. The applicator defined in claim 1 wherein each bracket comprises

A. a strap,

B. a clip at the upper end of the strap for resilient engagement to the wall of the container, and C. said means on the brackets for permitting relative movement including a generally U-shaped slot for loosely receiving the end of the axle, said slot being oriented to permit vertical movement of the axle when the bracket is clipped to the container wall, one leg of said slot having an open end permitting insertion of the axle into the slot, the other slot leg being closed to limit the upward travel of the axle in the container.

4. An applicator attachment for a paint tray for applying coating liquid to a painter pad, said applicator comprising A. an elongated roller formed with a circumferential array of lengthwise planar facets or faces, B. a pair of brackets having means adapted to be removably secured to the walls of said tray, and C. means on said roller for rotatively mounting the roller on and between the brackets.

5. The applicator defined in claim 4 wherein the roller has a polygonal cross-section.

* * * * *